US005947036A

United States Patent [19]

Cohen

[11] Patent Number: 5,947,036

[45] Date of Patent: Sep. 7, 1999

[54] SHELVING SYSTEM

[75] Inventor: Roni Cohen, Moshav Bney Atarot, Israel

[73] Assignee: Z A G Industries Ltd., Rosh Ha'Ayin, Israel

[ * ] Notice: This patent is subject to a terminal disclaimer.

[21] Appl. No.: 08/985,784

[22] Filed: Dec. 5, 1997

[51] Int. Cl.[6] ..... A47F 5/00

[52] U.S. Cl. ..... 108/110; 108/147.13; 108/151; 108/190; 108/14; 108/91; 108/26; 312/334.23; 211/188; 211/119.003; 206/326

[58] Field of Search ..... 108/14, 18, 25, 108/26, 53.3, 91, 106, 107, 186, 190, 147.12, 147.13, 147.11, 110, 151, 156, 157.13, 158.11, 901; 312/334.23, 245, 246; 211/188, 186, 187, 119.003, 86.01; 206/326

[56] References Cited

U.S. PATENT DOCUMENTS

| | | | |
|---|---|---|---|
| 3,129,042 | 4/1964 | Liener-kunde | 312/246 |
| 3,874,511 | 4/1975 | Maslow | 108/156 X |
| 4,138,953 | 2/1979 | Tashman | 108/147.13 |
| 4,635,563 | 1/1987 | Hand et al. | 108/147.13 X |
| 4,696,406 | 9/1987 | Karashima | 108/110 X |
| 4,706,824 | 11/1987 | Mercer et al. | 211/188 |
| 4,906,152 | 3/1990 | Kurihara | 411/508 X |
| 4,965,915 | 10/1990 | Steininger | 411/508 X |
| 4,976,360 | 12/1990 | Zucker et al. | 108/190 X |
| 5,205,630 | 4/1993 | Welch et al. | 108/107 X |
| 5,350,229 | 9/1994 | Smed | 312/348.3 X |
| 5,588,541 | 12/1996 | Goetz | 211/186 X |

*Primary Examiner*—Peter M. Cuomo
*Assistant Examiner*—Janet M. Wilkens
*Attorney, Agent, or Firm*—Pillsbury Madison & Sutro, LLP

[57] ABSTRACT

A shelving system features two spaced apart pairs of support rods deployed roughly vertically with a number of shelf assemblies supported thereby. Each shelf assembly is constructed from an open ended, molded polymer shelf having two openings in the upper surface adjacent to each of the open ends, and two suspension inserts engageable within the open ends. Each suspension insert has a pair of vertical bores, aligned with the openings when assembled, which are configured for forming suspension joints with the support rods. Since the precision vertical bores are contained within the separate suspension inserts, the main body of the shelf can be molded by techniques employing primarily longitudinal movement of mold parts, i.e., along the longest dimension of the shelves. In a preferred embodiment, each shelf is formed with support elements of closed cross-section extending along most or all of its length. Also disclosed is a snap-on drawer assembly for attachment to the underside of one of the shelves.

11 Claims, 12 Drawing Sheets

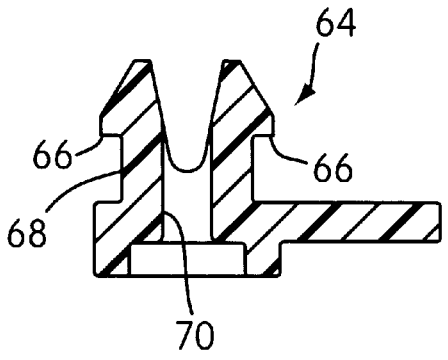
FIG. 13A
FIG. 13B
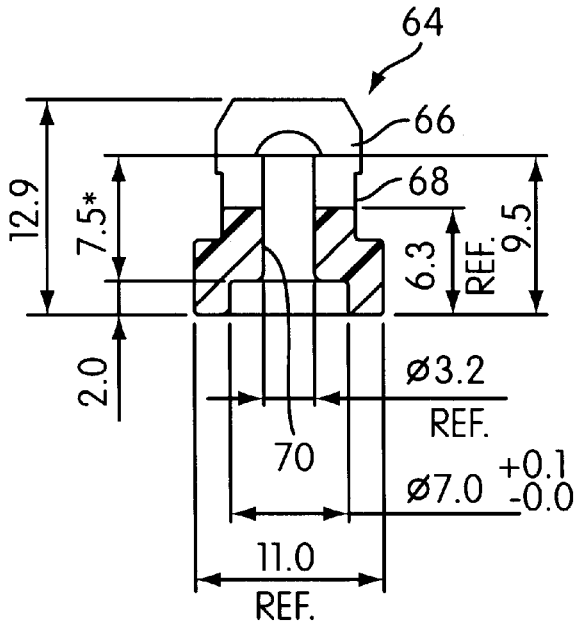
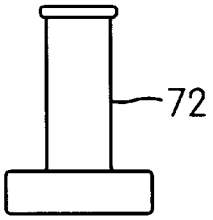
FIG. 14
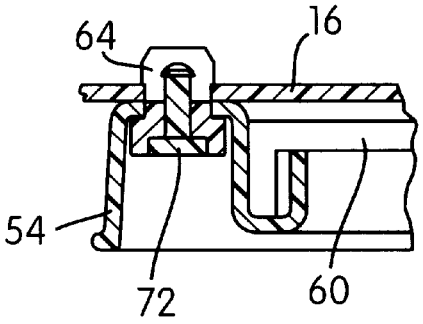
FIG. 15

SHELVING SYSTEM

FIELD AND BACKGROUND OF THE INVENTION

The present invention relates to shelving systems and, in particular, it concerns a molded plastic shelving system in which the shelves are formed from open ended structures with suspension inserts. The invention also provides a shelving system with a clip-in drawer assembly.

It is known to construct shelves systems from molded plastic. Typically, such systems have a number of shelves supported at their corners by four upright poles. The poles may be constructed from segments to allow them to be packed compactly. The shelves are typically reinforced with various ribs and the like, especially along their longest dimension.

It is known in the art that the strongest support structures are those having a closed cross-section. Closed support structures require molding techniques in which elongated mold parts move along the length of the supports. However, suspension of shelves on upright poles typically requires precisely molded vertical apertures which necessitate a vertical mold movement. As a result, conventional plastic shelves are limited to the use of weaker open support structures.

There is therefore a need for a molded plastic shelving system which employs suspension inserts to suspend open ended shelves from vertical support rods, thereby allowing the use of longitudinal movement molding techniques capable of forming closed cross-section supports along the length of the shelves.

SUMMARY OF THE INVENTION

The present invention is a molded plastic shelving system in which the shelves are formed from open ended structures with suspension inserts. The invention also provides a shelving system with a clip-in drawer assembly.

According to the teachings of the present invention there is provided, a shelving system comprising: (a) two spaced apart pairs of support rods deployed substantially vertically; (b) a plurality of shelves of molded polymer material, each of the shelves having two open ends and an upper surface, each of the shelves being formed with two openings in the upper surface adjacent to each of the open ends; and (c) for each of the shelves, two suspension inserts each having a pair of vertical bores configured for forming suspension joints with the support rods, the suspension inserts being configured such that, when they are engaged within the open ends, they form a closed shelf unit with the bores aligned with the openings.

According to another feature of the present invention, the vertical bores have a substantially conical internal surface for trapping retaining elements between the bores and the support rods.

According to another feature of the present invention, the suspension inserts further include retaining projections projecting inwardly into the bores so as to engage recesses in the support rods, thereby fixing a vertical position of the shelf unit.

According to another feature of the present invention, each of the shelves is formed with hollow supports of closed cross-section extending substantially continuously between the open ends.

According to another feature of the present invention, at least one of the hollow supports features an intermediate reinforced portion having an internal wall subdividing the closed cross-section, the internal wall extending along the direction of extension of the hollow supports.

According to another feature of the present invention, the hollow supports feature an intermediate portion, and the area of the closed cross-section varies along the length of at least one of the hollow supports, having a larger value adjacent to the open ends than within the intermediate portion.

According to another feature of the present invention, each of the shelves features at least three of the hollow supports including a front support, a rear support and an intermediate support, each of the supports having a depth, the depth of the intermediate support being less than about half of the depth of the front and rear supports.

According to another feature of the present invention, there is also provided a clip-on drawer assembly configured for attachment to the shelf units, the drawer assembly including a drawer, the drawer having dimensions such that it can be packed between two of the shelves when placed in abutment for storage without increasing a gross volume occupied by the two shelves.

There is also provided according to another feature of the present invention, a shelving system comprising: (a) a number of support rods deployed substantially vertically; (b) a plurality of shelves configured for mounting on the support rods; (c) a drawer frame configured for snap-on attachment to the underside of one of the shelves; and (d) a drawer slidably receivable within the drawer frame.

According to another feature of the present invention, the shelves and the drawer frame feature corresponding attachment holes, the system further comprising a plurality of snap-in flexible rivets snapably receivable within corresponding attachment holes of the shelves and the drawer frame for attaching the drawer frame to one of the shelves.

According to another feature of the present invention, each of the flexible rivets has a central bore, the system further comprising a plurality of locking pins to be inserted into the central bores after attachment of the drawer frame, the locking pins being configured so as to limit deformation of the flexible rivets, thereby preventing their removal.

BRIEF DESCRIPTION OF THE DRAWINGS

The invention is herein described, by way of example only, with reference to the accompanying drawings, wherein:

FIG. 13A is a first cross-sectional view through a snap-in flexible rivet for use in attaching drawer frame of FIG. 11;

FIG. 13B is a second cross-sectional view through a snap-in flexible rivet for use in attaching the drawer frame of FIG. 11;

FIG. 14 is a side view of a locking pin for securing the snap-in flexible rivet of FIGS. 13A and 13B;

FIG. 15 is a cross-sectional view illustrating the snap-in connection of the drawer frame to the shelving system employing the snap-in flexible rivet and locking pin of FIGS. 13–14.

DESCRIPTION OF THE PREFERRED EMBODIMENTS

The present invention is a shelving system.

The principles and operation of systems according to the present invention may be better understood with reference to the drawings and the accompanying description.

Figure 1:
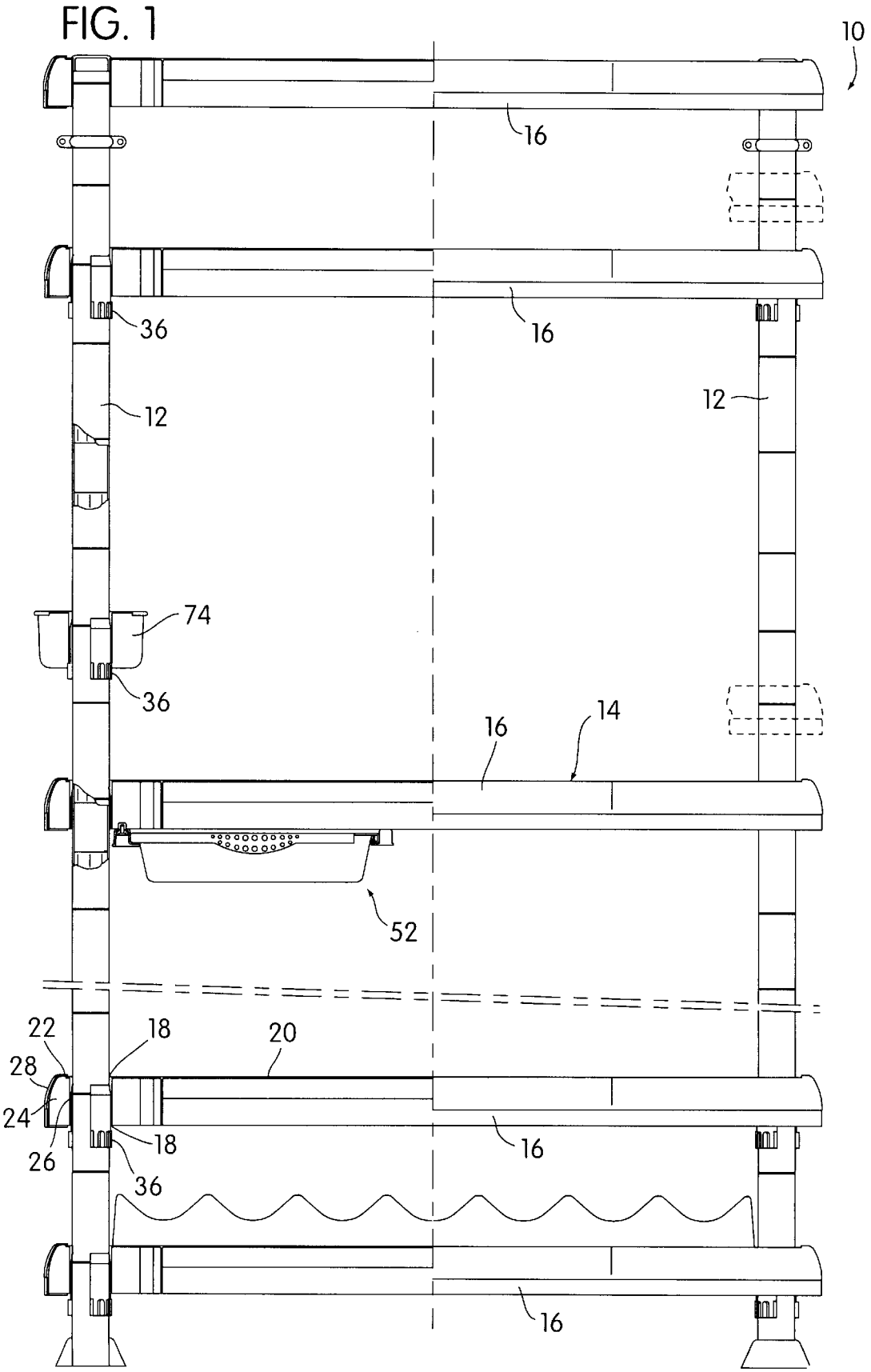
FIG. 1 is a partially cut-away front view of a shelving system, constructed and operative according to the teachings of the present invention.

Referring now to the drawings, FIG. 1 shows a shelving system, generally designated 10, constructed and operative according to the teachings of the present invention. Generally speaking, shelving system 10 features two spaced apart pairs of support rods 12 deployed substantially vertically with a number of shelf assemblies 14 supported thereby. Each shelf assembly 14 is constructed from an open ended, molded polymer shelf 16 having two openings 18 in the upper surface 20 adjacent to each of the open ends 22, and two suspension inserts 24 engageable within open ends 22. Each suspension insert 24 has a pair of vertical bores 26, aligned with openings 18 when assembled, which are configured for forming suspension joints with support rods 12. Where shelf 16 also has a lower surface adjacent to open ends 22, openings 18 are also provided through the lower surface.

It will be readily apparent that the shelf assembly structure described provides major advantages. Since the precision vertical bores are contained within the separate suspension inserts, the main body of the shelf can be molded by techniques employing primarily longitudinal movement of mold parts, i.e., along the longest dimension of the shelves. Thus, in a preferred embodiment, each shelf is formed with support elements of closed cross-section extending along most or all of its length. As mentioned above, such a structure cannot be achieved by the direct molding techniques of the prior art which must produce precision vertical bores through a singe shelf element.

Figure 2:
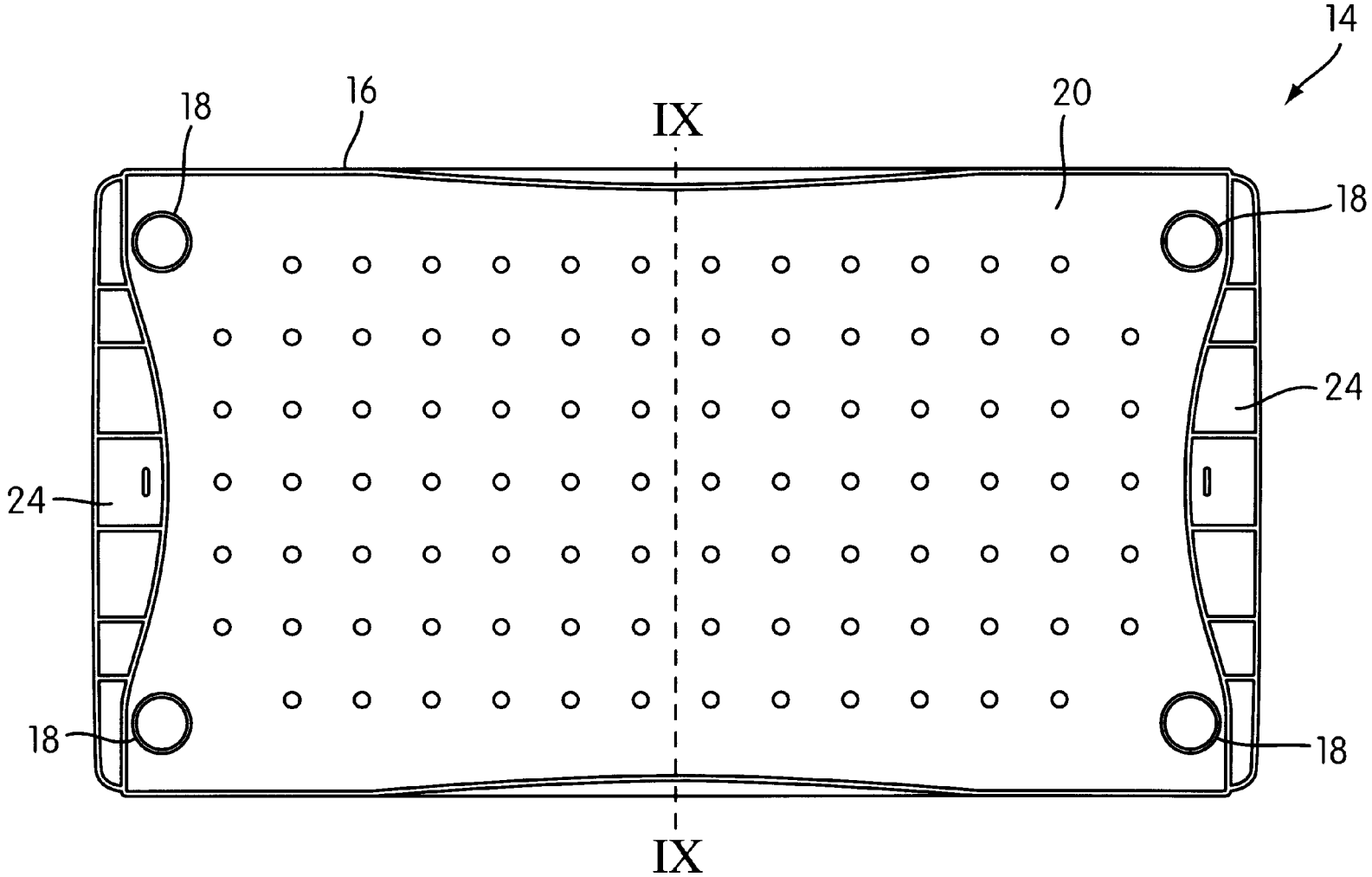
FIG. 2 is a plan view of a shelf assembly from the shelving system of FIG. 1.

Turning now to the details of shelving system 10 in more detail, FIG. 2 shows a shelf assembly 14 viewed from above. Upper surface 20, shown here with small ventilation apertures, may have any desired pattern of apertures, ranging from an open lattice to a continuous closed surface. The surface itself may be smooth or textured, and a rim may be provided. The surface may also support a secondary structure such as, for example, the bottle rack shown on the lowest shelf of FIG. 1.

Figure 3:
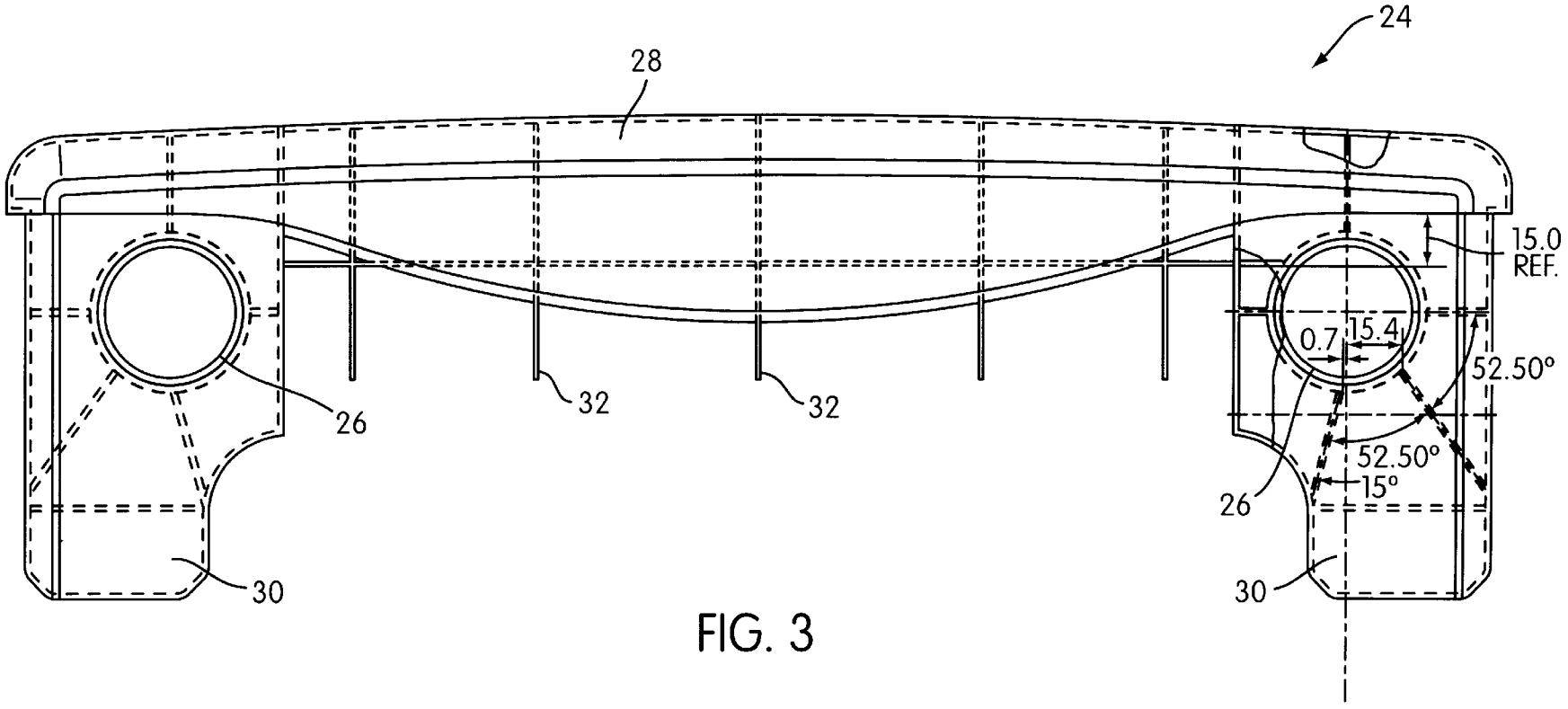
FIG. 3 is a plan view of a suspension insert from the shelf assembly of FIG. 2.

The structure of a suspension inserts 24 is shown in FIG. 3. An outer casing 28 is shaped to complement the outer dimensions and contours of shelf 16 to form the visible ends of an attractive closed shelf assembly when assembled. Extending from casing 28 are two plug elements 30 which are shaped to engage within open ends 22 of shelves 16. Additional ribs 32 also extend from casing 28 to provide support to the upper surface 20. Optionally, a resilient catch structure (not shown) may be provided for retaining suspension insert in engagement with open ends 22.

Vertical bores 26 are produced with one of two possible configurations, a first for forming an adjustable suspension joint, and a second for forming a fixed suspension joint. A typical implementation of shelving system 10 features a number of fixed shelves and a number of adjustable shelves. The numbers of each are dictated by the number of suspension inserts 24 provided with each type of vertical bore.

Figure 4:
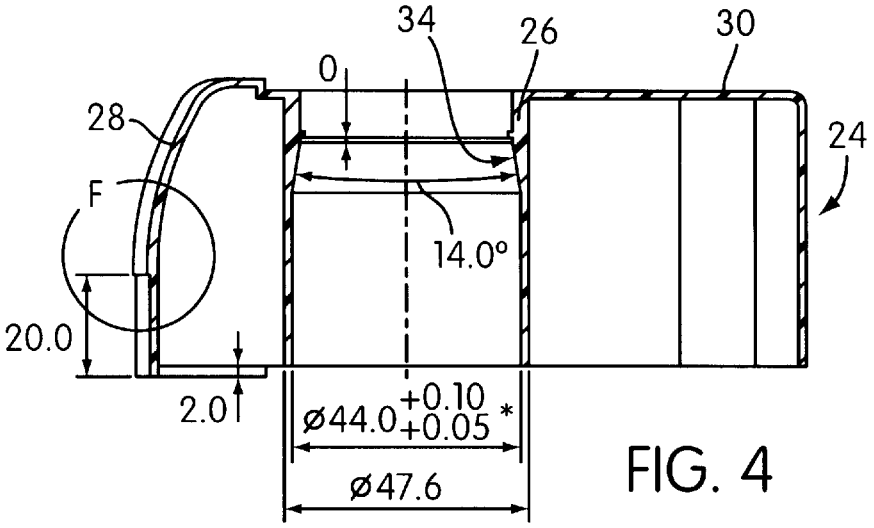
FIG. 4 is a cross-sectional view through a vertical bore of a first implementation of the suspension insert of FIG. 3 for forming an adjustable suspension joint.
Figure 5:
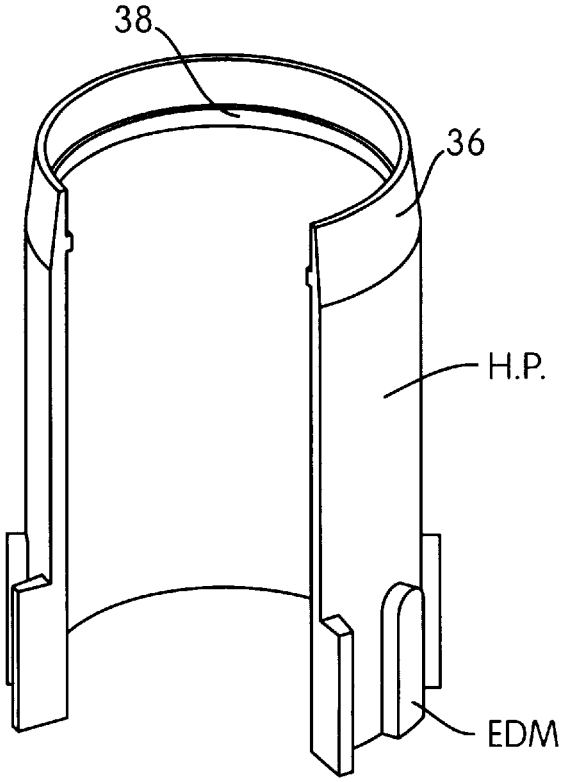
FIG. 5 is an isometric view of a locking element for use with suspension insert of FIG. 4.
Figure 6A:
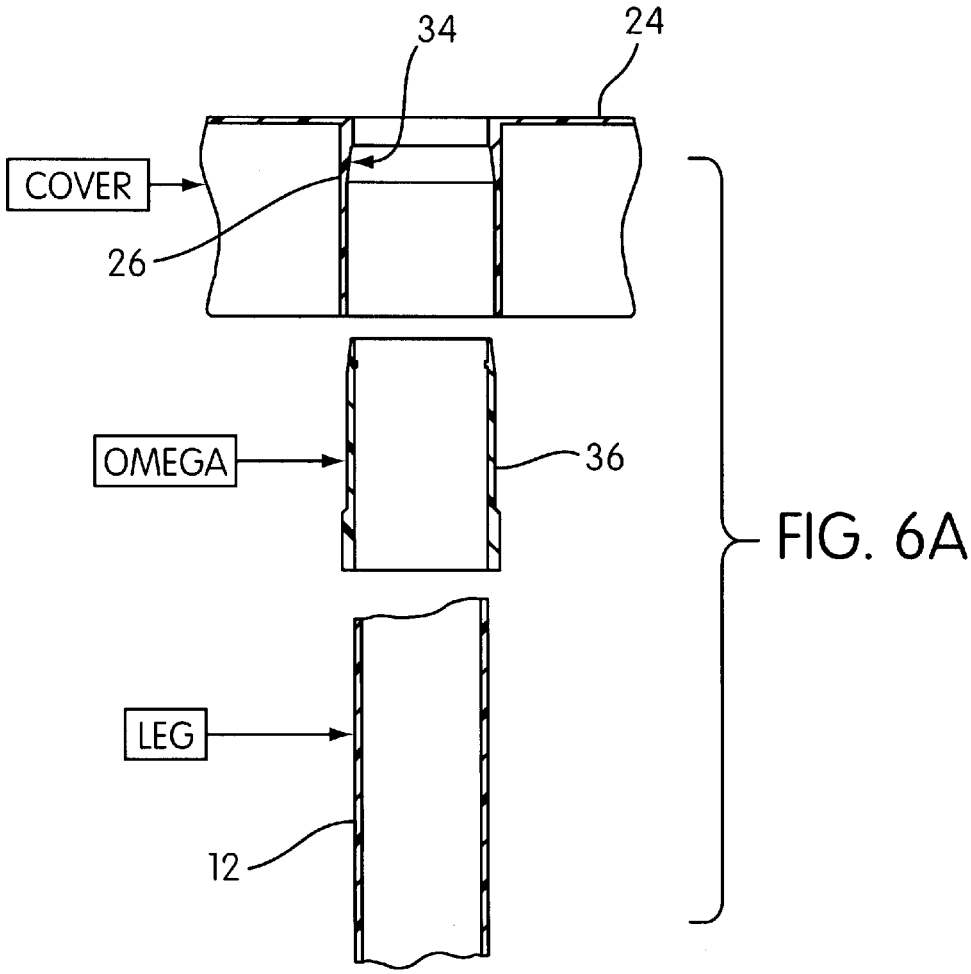
FIG. 6A is an exploded cross-sectional view of an adjustable suspension joint.
Figure 6B:
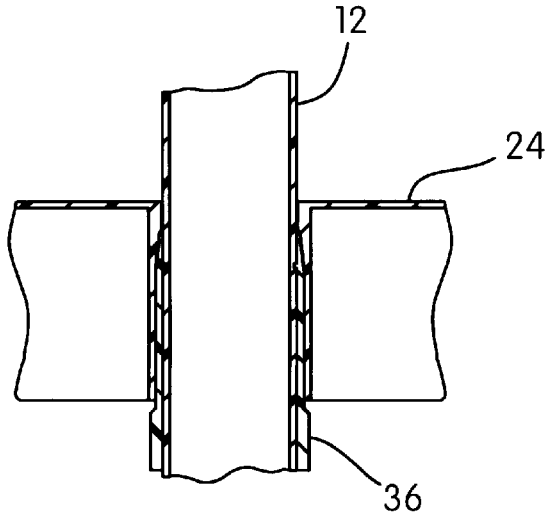
FIG. 6B is an assembled cross-sectional view of an adjustable suspension joint.

The structure of vertical bore 26 for forming an adjustable suspension joint is illustrated in FIG. 4. Here, bore 26 is formed with a substantially conical internal surface 34 along a part of its length. This structure is used in conjunction with a snap-on retaining element 36 as shown in FIG. 5. Retaining element has an inwardly projecting ridge 38 which is configured to engage corresponding circular indentations around support rods 12. Part of the outer surface of retaining element 36 has an upward-facing conical surface complementing conical internal surface 34. FIGS. 6A and 6B illustrate the assembly of the adjustable suspension joint. First retaining element 36 is clipped into place engaging an indentation at the desired height on support rods 12. Then, the shelf assembly is lowered onto the retaining element until internal surface 34 wedges onto the conical surface of retaining element 36. trapping the retaining element between bore 26 and support rods 12.

Figure 7:
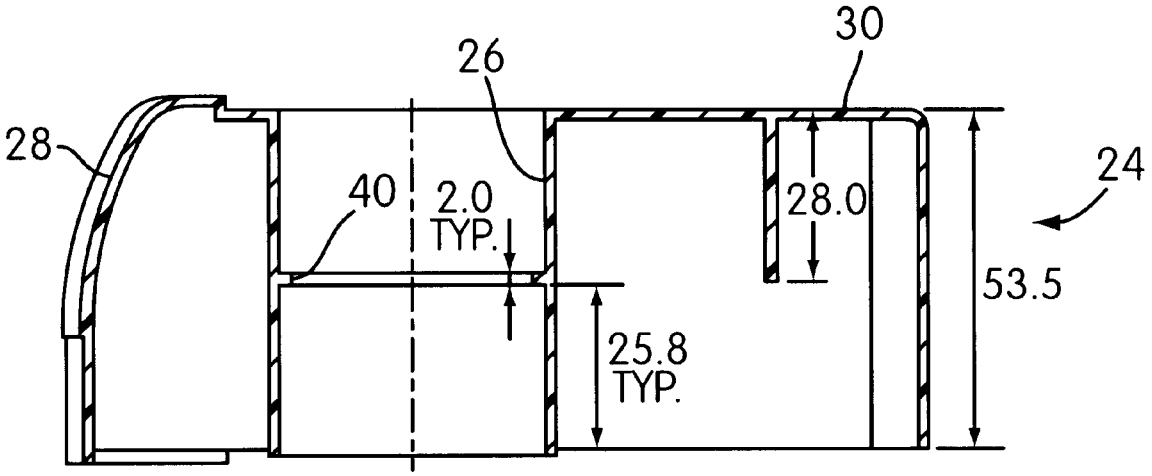
FIG. 7 is a cross-sectional view through a vertical bore of a second implementation of the suspension insert of FIG. 3 for forming a fixed suspension joint.

FIG. 7 illustrates the structure of vertical bore 26 for forming a fixed suspension joint. Here, an inwardly projecting ridge 40, equivalent to ridge 38, is formed as an integral part of the inner surface of bore 26. Shelf assemblies having this configuration of bore 26 are engaged between adjacent sections of support rods 12 at desired positions during initial assembly of the rods.

Figure 8:
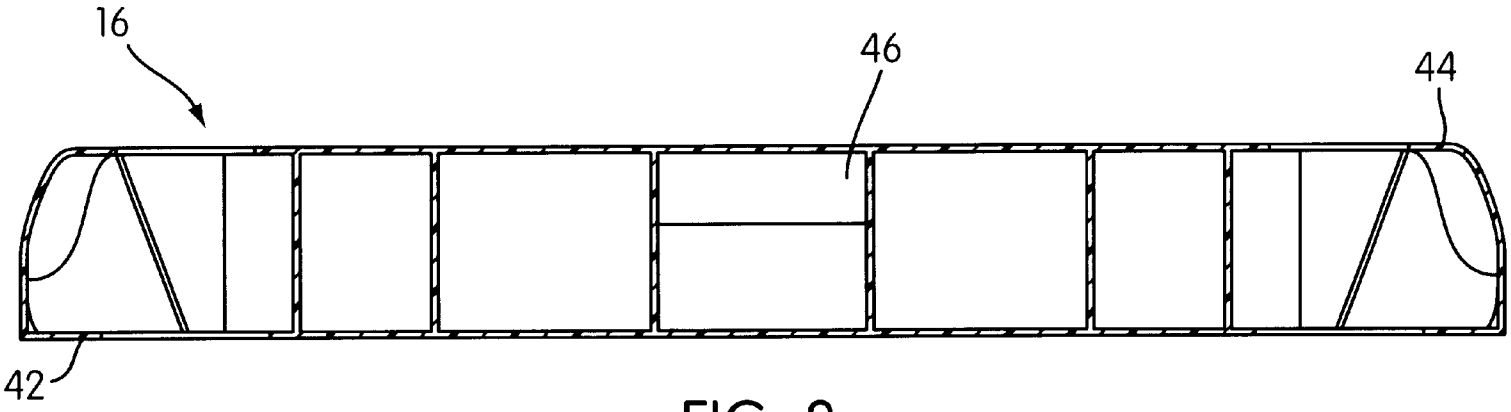
FIG. 8 is an end view of the shelf of FIG. 2 with the suspension insert removed.
Figure 9:
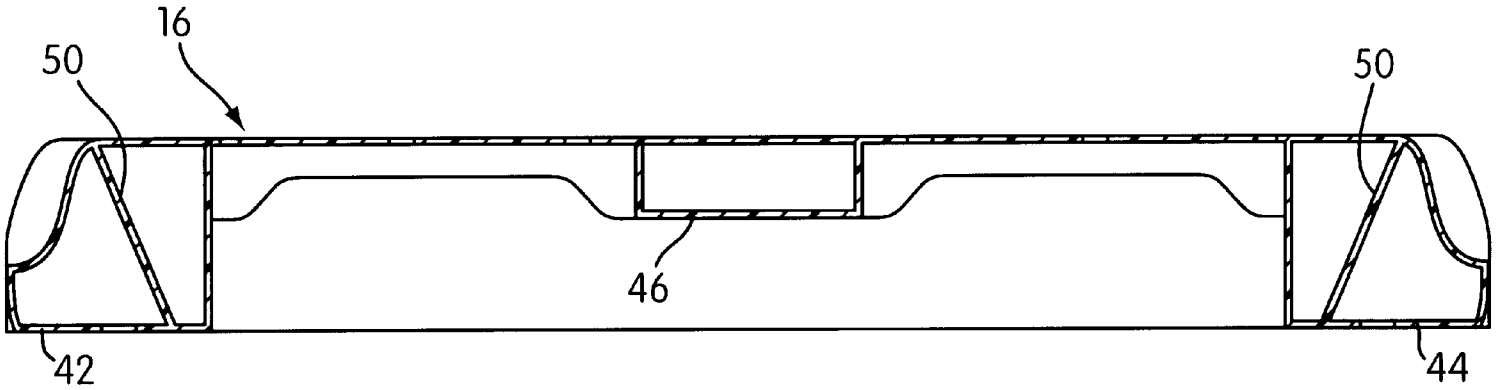
FIG. 9 is a cross-sectional view through the shelf of FIG. 2 taken along the line IX—IX.

As mentioned above, shelves 16 are preferably formed with hollow supports of closed cross-section extending substantially continuously between open ends 22. The structure of these supports is best seen in FIGS. 8 and 9.

Figure 10:
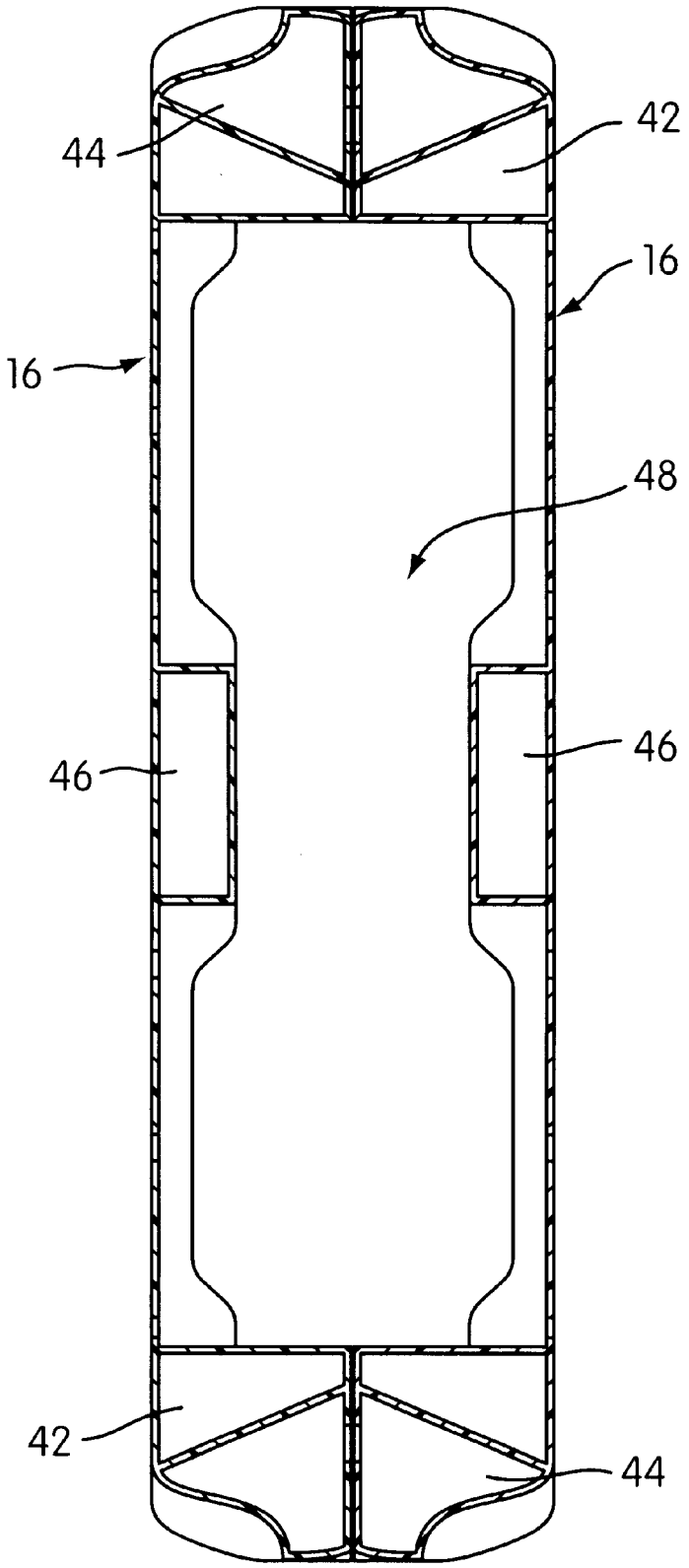
FIG. 10 is a view similar to FIG. 9 showing two similar shelves positioned together for packaging.

Each shelf 16 typically features at least three such supports including a front support 42, a rear support 44, and at least one intermediate support 46. The primary support is provided by the front and rear supports 42 and 44 which, together with suspension inserts 24, for a strong outer frame. Intermediate supports 46 preferably have a depth of less than about half of the depth of the front and rear supports. This latter feature allows particularly compact packaging of shelving system 10, dissembled support rods and other accessories being stored in the cavities 48 between juxtaposed shelves as shown in FIG. 10.

The hollow supports are described as extending "substantially continuously" between open ends 22. In this context, it should be noted that the supports may be interrupted by a solid transverse wall at or near the middle of their length. Furthermore, although the supports are preferably of closed cross-section right up to open ends 22, this is not necessarily so.

Similarly, it should be understood that the closed cross-section referred to need not be uniform along the length of the supports. Thus, in the examples shown here, both internal and external features of front and rear supports 42 and 44 vary along their length.

Specifically, an intermediate portion of front and rear supports 42 and 44 is formed with an internal wall 50, extending along the direction of extension of the hollow supports, which subdivides the closed cross-section. This adds extra rigidity in the portion of the shelf furthest from support rods 12. In addition, the presence of symmetrical longitudinal grooves in the extremities of the elongated mold parts used to form the hollow supports helps maintain alignment of the mold parts during injection.

A further feature of the intermediate portion is that the area of the closed cross-section varies along the length of front and rear supports 42 and 44 having a larger value adjacent to open ends 22 than within the intermediate portion. This can be seen from the different cross-sectional shapes of front and rear supports 42 and 44 viewed in FIGS. 8 and 9, forming a recessed intermediate portion of the outer edge of the shelf as seen in the top view of FIG. 2.

Turning now to the details of certain accessories included in preferred implementations of shelving system 10, a snap-on drawer module 52 will now be described with particular reference to FIGS. 11–15. It should be appreciated that, although it will be described in the context of shelving system 10, snap-on drawer module 52 could also be used to advantage with a range of other modular shelving systems of different constructions.

Figure 11:
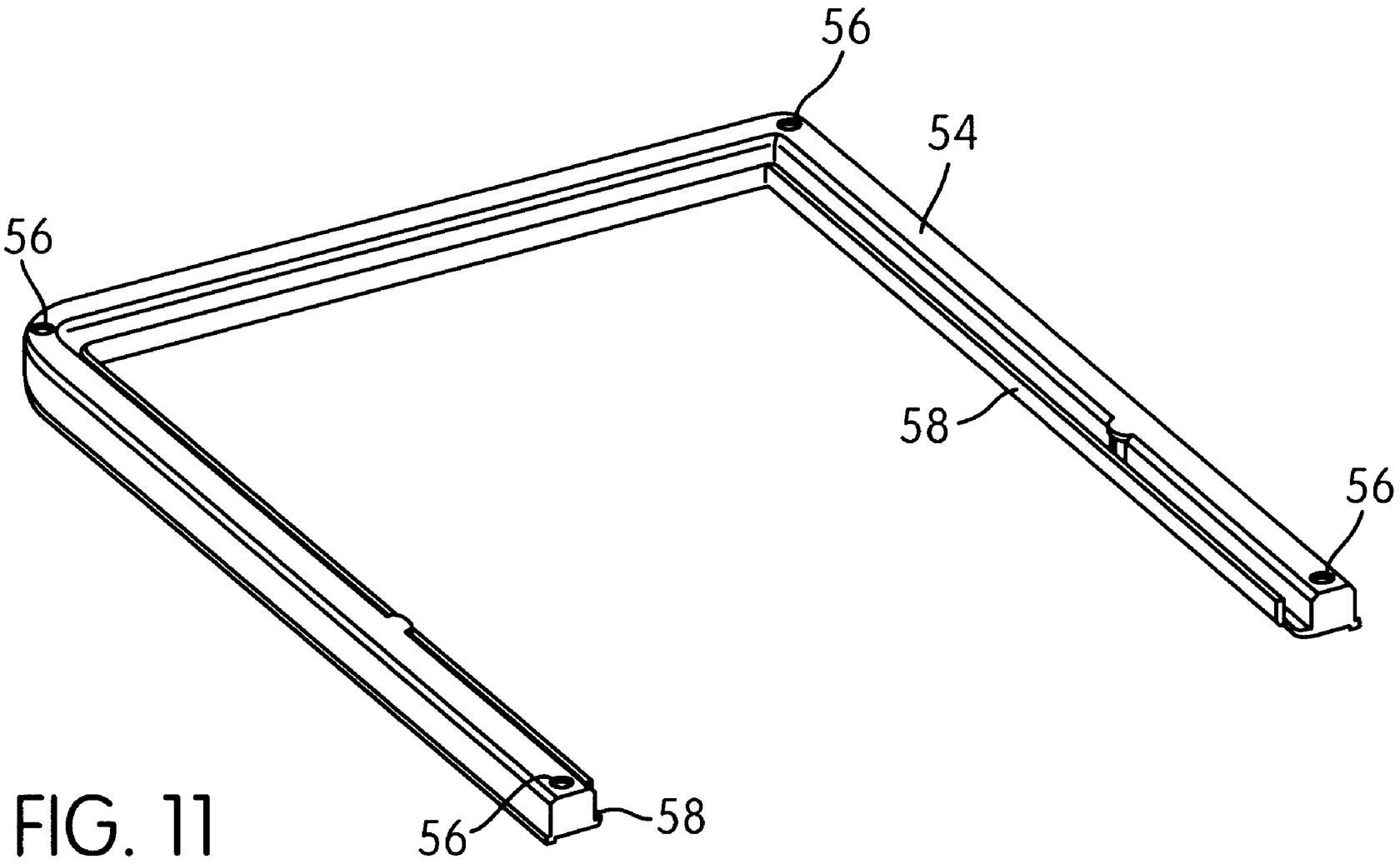
FIG. 11 is an isometric view of a snap-on drawer frame from the shelving system of FIG. 1.

FIG. 11 shows a first component of drawer module 52, namely, a drawer frame 54 which is configured for snap-on attachment to the underside of one of the shelves. In this case, attachment is achieved by snap-in elements which engage four mounting holes 56 positioned to align with corresponding holes in the underside of each shelf.

Figure 12:
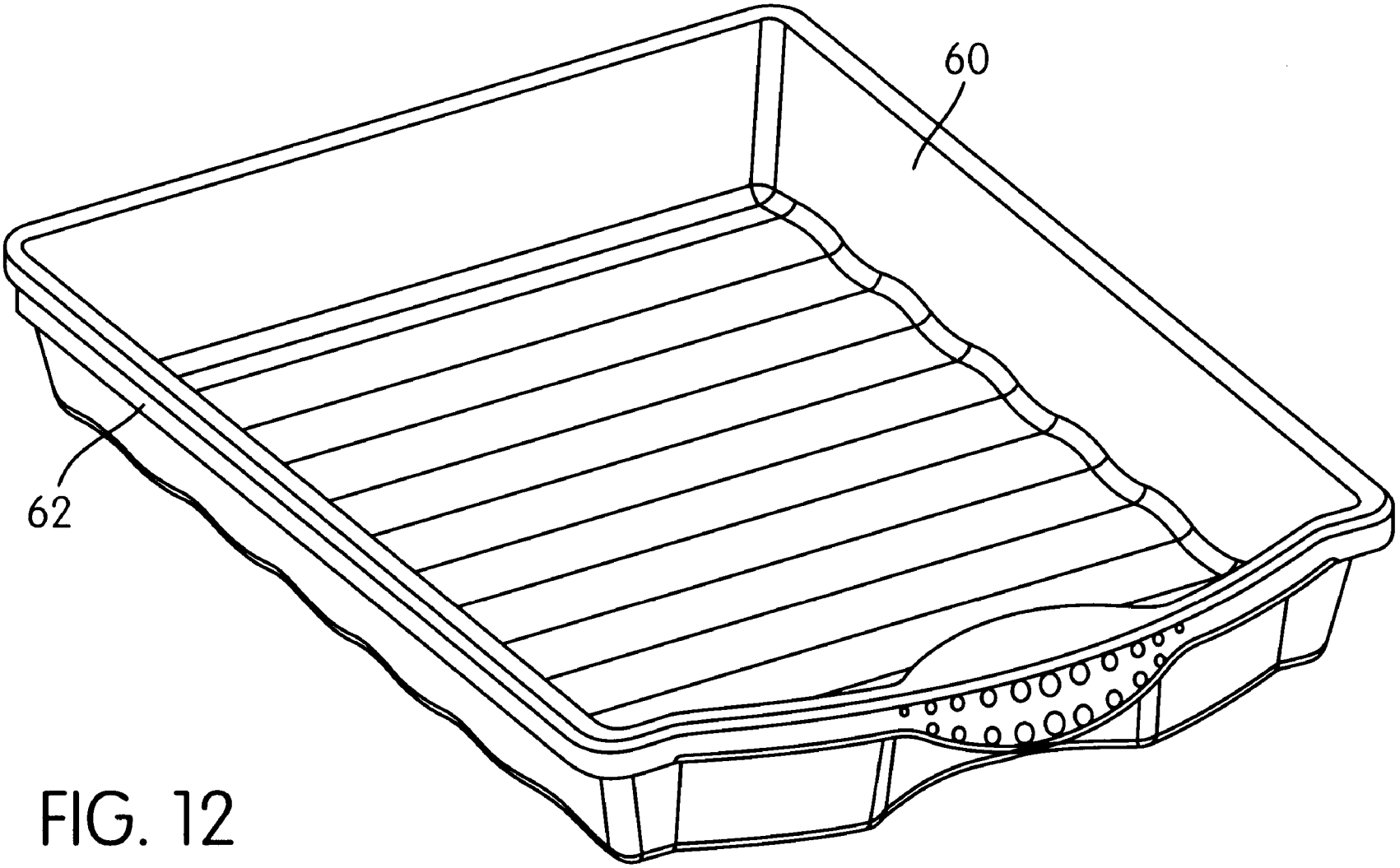
FIG. 12 is an isometric view of a drawer from the shelving system of FIG. 1.

Drawer frame 54 has a generally U-shaped form, the side arms having open-ended runners 58 along which a drawer can slide. FIG. 12 shows a drawer 60 having lateral ledges 62 configured for slidably engaging with runners 58.

FIGS. 13–15 illustrate a preferred manner of attachment of drawer frame 54 to the underside of shelf 16. FIGS. 13A and 13B show a snap-in flexible rivet 64 which, when forced through one of mounting holes 56 and the corresponding hole in the underside of the shelf, snaps into place to attach drawer frame 54 to the shelf. Each flexible rivet 64 has a forked end with barbed projections 66 which is sufficiently flexible to be forced through a hole of diameter equal to that of the non-barbed neck 68 of the rivet. Each rivet 64 also features a central, axial bore 70 with a recessed head.

FIG. 14 shows a locking pin 72 configured to be inserted into central bore 70. The complete structure of this snap-in connection is shown in FIG. 15. First, drawer frame 54 is positioned below one of shelves 16 with its mounting holes 56 aligned with the corresponding holes in shelf 16. Then, one rivet 64 is pressed through the aligned holes to attach the drawer frame to the shelf. After attachment, one locking pin 72 is inserted along central bore 70 of each rivet 64. The locking pins serve to limit inward deformation of the flexible end of the rivets, thereby preventing their removal. Drawer 60 can then be inserted and is ready for use. The complete drawer module 52 can be seen in FIG. 1.

Parenthetically, it should be noted that the dimensions of all the components of drawer module 52 are chosen to allow them to be packed within cavities 48. Specifically, the depth of drawer 60 is preferably less than twice the depth of shelf 16 less twice the depth of intermediate support 46. Similarly, at least one of the length and width (i.e., horizontal dimensions in its final orientation) of both drawer frame 54 and drawer 60 is chosen to be less than the separation between the front and back supports 42 and 44. In this way, drawer module 52 can be packed between two of the shelves when placed in abutment for storage without increasing a gross volume occupied by the two shelves.

Figure 16:
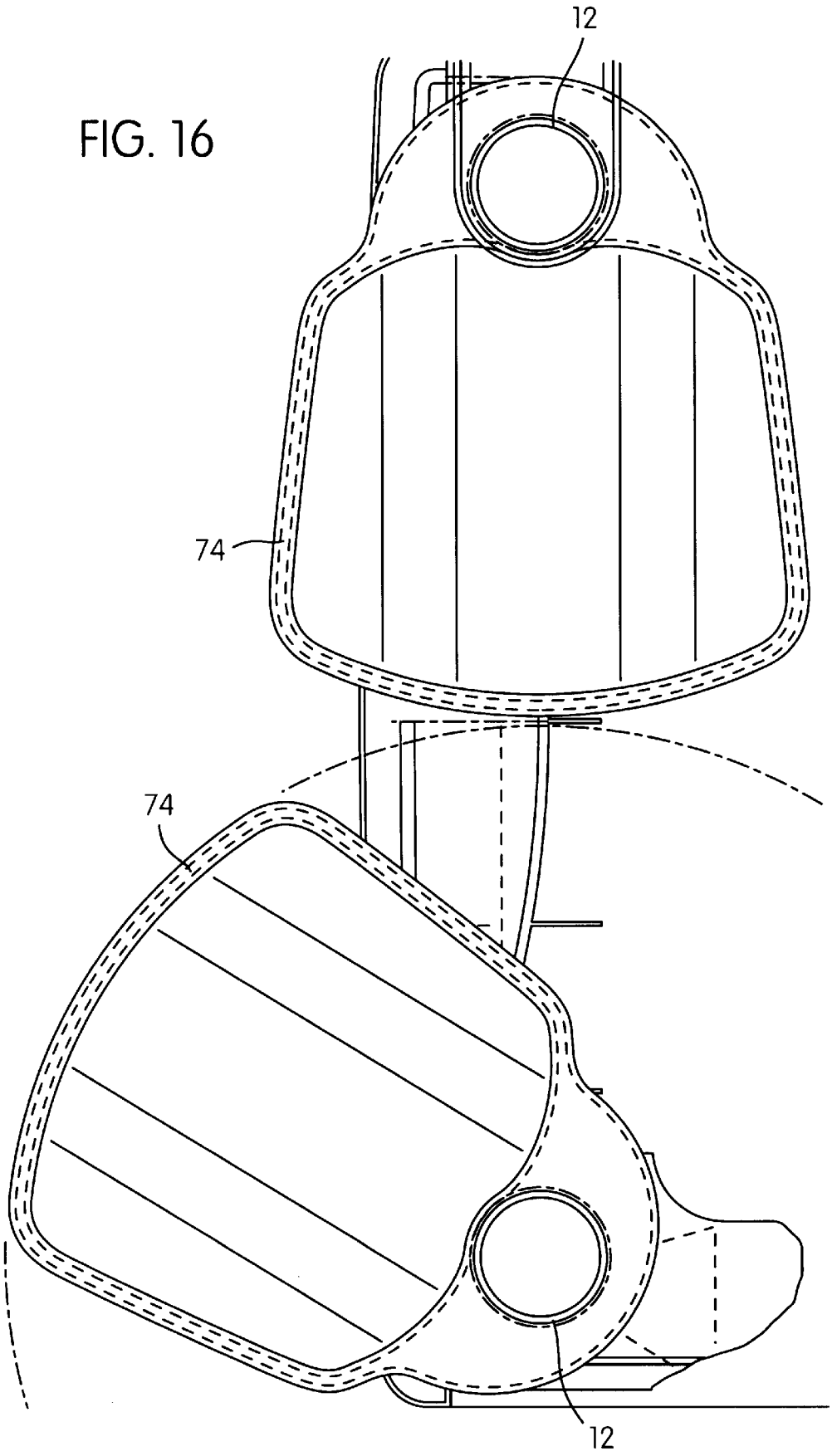
FIG. 16 is a plan view showing two swing-out trays of the shelving system of FIG. 1.

Finally, turning briefly to FIG. 16, there are shown two further accessories for shelving system 10, namely, a pair of swing-out trays 74. Each swing-out tray 74 is mounted on a single support rod 12 at a desired height in a manner similar to the adjustable suspension joints described with reference to FIGS. 4–6 above. Trays 74 can then be swung out so as to project from the side of shelving system 10 for easy access. When not being accessed, they can be swung back to a storage position between support rods 12.

It will be appreciated that the above descriptions are intended only to serve as examples, and that many other embodiments are possible within the spirit and the scope of the present invention.

What is claimed is:

1. A shelving system comprising:

(a) two spaced apart pairs of support rods deployed substantially vertically;

(b) a plurality of shelves of molded polymer material, each of said shelves having two open ends and an upper surface, each of said shelves being formed with two openings in said upper surface adjacent to each of said open ends; and (c) for each of said shelves, two suspension inserts each having a pair of vertical bores configured for forming suspension joints with said support rods, said suspension inserts being configured such that, when they are engaged within said open ends, they form a closed shelf unit with said bores aligned with said openings.

2. The shelving system of claim 1, further comprising a plurality of retaining elements configured for attachment to said support rods, wherein said vertical bores of at least two of said suspension inserts have a substantially conical internal surface for trapping said retaining elements between said bores and said support rods.

3. The shelving system of claim 1, wherein at least two of said suspension inserts corresponding to at least one of said shelf units further include retaining projections projecting inwardly into said bores so as to engage recesses in said support rods, thereby fixing a vertical position of said at least one shelf unit.

4. The shelving system of claim 1, wherein each of said shelves is formed with hollow supports of closed cross-section extending substantially continuously between said open ends.

5. The shelving system of claim 4, wherein at least one of said hollow supports of at least one of said shelves features an intermediate reinforced portion having an internal wall subdividing said closed cross-section, said internal wall extending along the direction of extension of said hollow supports.

6. The shelving system of claim 4, wherein said hollow supports of at least one of said shelves feature an intermediate portion, and wherein the area of said closed cross-section varies along the length of at least one of said hollow supports, having a larger value adjacent to said open ends than within said intermediate portion.

7. The shelving system of claim 4, wherein each of said shelves features at least three of said hollow supports including a front support, a rear support and an intermediate support, each of said supports having a depth, said depth of said intermediate support being less than about half of said depth of said front and rear supports.

8. The shelving system of claim 7, further comprising a clip-on drawer assembly configured for attachment to said shelf units, said drawer assembly including a drawer, said drawer having dimensions such that it can be packed between two of said shelves when placed in abutment for storage without increasing a gross volume occupied by said two shelves.

9. The shelving system of claim 1, further comprising:

(a) a drawer frame configured for snap-on attachment to the underside of one of said shelves; and (b) a drawer slidably receivable within said drawer frame.

10. The shelving system of claim 9, wherein at least one of said shelves and said drawer frame feature corresponding attachment holes, the system further comprising a plurality of snap-in flexible rivets snapably receivable within corresponding attachment holes of said at least one of said shelves and said drawer frame for attaching said drawer frame to one of said shelves.

11. The shelving system of claim 10, wherein each of said flexible rivets has a central bore, the system further comprising a plurality of locking pins to be inserted into said central bores after attachment of said drawer frame, said locking pins being configured so as to limit deformation of said flexible rivets, thereby preventing their removal.

* * * * *